US007723626B2

(12) United States Patent
Harris

(10) Patent No.: US 7,723,626 B2
(45) Date of Patent: May 25, 2010

(54) HAPTICS CONE

(75) Inventor: Daren L. Harris, Canton, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 562 days.

(21) Appl. No.: 11/804,526

(22) Filed: May 19, 2007

(65) Prior Publication Data

US 2008/0283377 A1 Nov. 20, 2008

(51) Int. Cl.
*H01H 9/00* (2006.01)

(52) U.S. Cl. ..... 200/296; 200/341

(58) Field of Classification Search ..... 200/517, 200/520, 293–296, 341, 344, 345; 341/22, 341/24; 345/168, 169
See application file for complete search history.

(56) References Cited

U.S. PATENT DOCUMENTS

| | | | | |
|---|---|---|---|---|
| D323,613 | S | 2/1992 | Cummins et al. | |
| 5,252,798 | A | 10/1993 | Kamada | |
| 5,477,942 | A | 12/1995 | Shea et al. | |
| 5,651,450 | A | 7/1997 | Priesemuth | |
| 5,697,493 | A | 12/1997 | Sach et al. | |
| 5,727,675 | A * | 3/1998 | Leveque et al. | 200/524 |
| 5,739,486 | A | 4/1998 | Buckingham | |
| 6,310,308 | B1 | 10/2001 | Watson et al. | |
| 6,335,500 | B1 | 1/2002 | Chi et al. | |
| 6,369,800 | B1 | 4/2002 | Nading et al. | |
| 6,590,174 | B2 | 7/2003 | Zysnarski et al. | |
| 6,664,491 | B2 | 12/2003 | Yanai et al. | |
| 6,670,565 | B2 | 12/2003 | Hanahara et al. | |
| 6,747,226 | B2 | 6/2004 | Watanabe | |
| 6,770,829 | B1 | 8/2004 | Hart | |
| 6,809,278 | B2 * | 10/2004 | Tsubaki | 200/341 |
| 6,998,554 | B2 | 2/2006 | Shimoda et al. | |
| 7,002,092 | B2 * | 2/2006 | Ichimaru | 200/523 |
| 7,034,240 | B1 | 4/2006 | Wang | |
| 7,049,530 | B2 | 5/2006 | Hayashizaki | |
| 7,064,287 | B2 * | 6/2006 | Kameda | 200/341 |
| 7,067,754 | B2 | 6/2006 | Weston et al. | |
| 7,122,756 | B2 | 10/2006 | Sasaki et al. | |
| 7,129,432 | B2 | 10/2006 | Fujii et al. | |
| 7,135,650 | B2 | 11/2006 | Jung | |
| 7,164,092 | B2 * | 1/2007 | Kawano | 200/310 |
| 7,186,935 | B2 * | 3/2007 | Lee et al. | 200/310 |
| 7,265,307 | B2 * | 9/2007 | Miyasaka et al. | 200/314 |

(Continued)

OTHER PUBLICATIONS

U.S. Appl. No. 11/624,685, filed Jan. 18, 2007, Orr et al.

*Primary Examiner*—Michael A Friedhofer
(74) *Attorney, Agent, or Firm*—Brinks Hofer Gilson & Lione

(57) ABSTRACT

A push button assembly has a button retainer having drawer slide guides and a corresponding bezel structure. The button retainer also has a surface perpendicular to a principal translational axis, on which is one of a conical protrusion and a conical indentation is formed. The bezel structure has the other of the conical protrusion and conical indentation. The conical indentation mates with the conical protrusion such that the conical protrusion and the portions forming the conical indentation are in contact around their perimeters when the button retainer and bezel structure are in a pre-load position. A method of producing the button retainer and bezel structure is also disclosed, which includes attaching an attachment mold pin to the molds, which can be altered and reattached in the tuning process.

19 Claims, 1 Drawing Sheet

U.S. PATENT DOCUMENTS 7,309,856 B2 * 12/2007 Yamamoto ..... 250/239
7,348,511 B2 * 3/2008 Chen et al. ..... 200/296
7,564,000 B2 * 7/2009 Chen et al. ..... 200/296
7,592,559 B2 * 9/2009 Blake, III ..... 200/296
7,592,560 B1 * 9/2009 Lai ..... 200/296
7,635,820 B2 * 12/2009 Shen et al. ..... 200/314
2002/0066660 A1 6/2002 Ardrey et al.
2005/0279618 A1 12/2005 Lau et al.

* cited by examiner

HAPTICS CONE

BACKGROUND OF THE INVENTION

1. Field of the Invention

This invention relates to a push button assembly, and more particularly, a push button assembly having drawer slide guides.

2. Description of Related Art

Push buttons are used to control a wide variety of electronic equipment, including electronic equipment within automobiles. Examples of such uses are buttons for audio applications, driver's information applications, climate control, four-wheel drive activation/deactivation, door switches, and seat movement applications, to name a few.

Push buttons having a transparent or translucent display portion on the front surface are known in the art. These types of push buttons have a light guiding portion, called the button retainer, extending from the back of the push button and extending through a bezel structure. Often, multiple drawer slide guides protrude from the side of the button retainer in order to control friction and wobble.

Button retainers and bezel structures of the type herein are generally made of plastic and injection molded from steel molds. In order to minimize both the friction between the button retainer and the bezel structure and the wobble of the button retainer within the bezel structure, the button retainer and corresponding bezel structure must meet accurate tolerances. Often, as friction is decreased, wobble increases, and vice versa.

In addition to controlling friction and wobble, button design also involves maximizing the lightable area, minimizing the gap between the button retainer and the bezel structure, ensuring adequate button travel, and maximizing the durability of the button assembly. Attempting to satisfy all of these design parameters causes a button to become over-constrained.

A bezel structure is often tuned to fit a button retainer by a process that involves cutting the mold for the bezel structure to one side of a predetermined tolerance band, leaving gaps for the drawer slide guides of the button retainer. Next, the bezel structure is injection molded, and the button retainer is fit within the bezel structure. Measurements are made for adjusting the bezel mold to fit the button guides to accurate tolerances. Then, the bezel mold is re-cut or material is added to the bezel mold. Tuning the multiple drawer slide guides in three dimensions along multiple axes is difficult to control and difficult to package, especially now that bezel structures are designed with computers.

In view of the above, it is apparent that there exists a need for a button retainer and bezel that meet design demands from both a friction and a wobble standpoint. Furthermore, there exists a need for a button retainer and bezel structure in which tuning the button retainer to fit within the bezel structure is easier to control and more accurate.

BRIEF SUMMARY OF THE INVENTION

The present invention provides a button retainer and bezel structure having a single contact point. The single contact point helps control wobble without substantially increasing friction and helps reduce or eliminate rattle noise during vibration. The tuning process may also be simplified. The present invention provides a process that may be used to create the button retainer and bezel structure, allowing time to be saved in the tuning process.

A push button assembly is provided, which includes a button retainer and a corresponding bezel structure. The button retainer has a first drawer slide guide disposed along a first plane, the first plane being parallel to a principal translational axis of the button retainer, and a second drawer slide guide disposed along a second plane, the second plane being parallel to the principal translational axis of the button retainer and perpendicular to the first plane. A surface is disposed along a third plane, the third plane being perpendicular to the first and second planes and the principal translational axis. A conical protrusion extends from the surface. The conical protrusion includes an outer conical side having a perimeter. The bezel structure has a plurality corresponding surfaces, and each corresponding surface is mated with one of the first and second drawer slide guides. The bezel structure also has portions forming a conical indentation. The portions forming the conical indentation include an inner conical side having a perimeter. The outer conical side of the button retainer is configured to mate with the inner conical side of the bezel structure in a pre-load position, such that the outer and inner conical sides contact each other around their perimeters. In a depressed position, the conical protrusion is configured to move away from the portions forming the conical indentation.

In another embodiment, the conical protrusion is formed as part of the bezel structure, and the portions forming the conical indentation are formed as part of the button retainer.

In yet other embodiments, the protrusion has an elliptical shape and corresponds to portions forming an elliptical indention.

In another aspect, a method of producing a button assembly, such as a push button assembly or hinge button assembly, is provided. The method includes providing an attachment pair, which includes a cone mold pin and a corresponding conical pocket pin, at one side of a predetermined tolerance band for use with one of a retainer mold and a bezel mold. A retainer mold for molding a button retainer and a bezel mold for molding a bezel structure are provided, each having an aperture for attaching one of the attachment pair. One of the attachment pair is attached within each aperture. Then, the button retainer is molded from the retainer mold, and the bezel structure is molded from the bezel mold, which produces a molded piece that includes a conical protrusion having an outer conical side with an outer perimeter and a molded piece that includes corresponding portions forming a conical indentation having an inner conical side with an inner perimeter. The method then involves fitting the conical protrusion within the corresponding conical indentation and determining whether the outer conical side contacts the inner conical side around the perimeters of each of the inner and outer conical sides. If the inner and outer conical sides do not contact each other around their perimeters, the method involves altering at least one component of the attachment pair, reattaching the component of the attachment pair to at least one of the retainer mold and the bezel mold, and remolding at least one of the button retainer and the bezel structure. The method involves continuing to: 1) alter at least one component of the attachment pair, 2) reattach the component of the attachment pair to at least one of the retainer mold and the bezel structure, and 3) remold at least one of the button retainer and the bezel structure until the inner and outer conical sides contact each other around their perimeters.

DETAILED DESCRIPTION OF THE INVENTION

The present invention provides a novel and nonobvious push button assembly that allows wobble to be controlled to a tight tolerance while the button is under pre-load, while allowing the button to move freely when the button is depressed. The present invention also provides a novel and nonobvious process that simplifies the molding tools for a push button assembly, thereby reducing lead times and costs.

Figure 1:
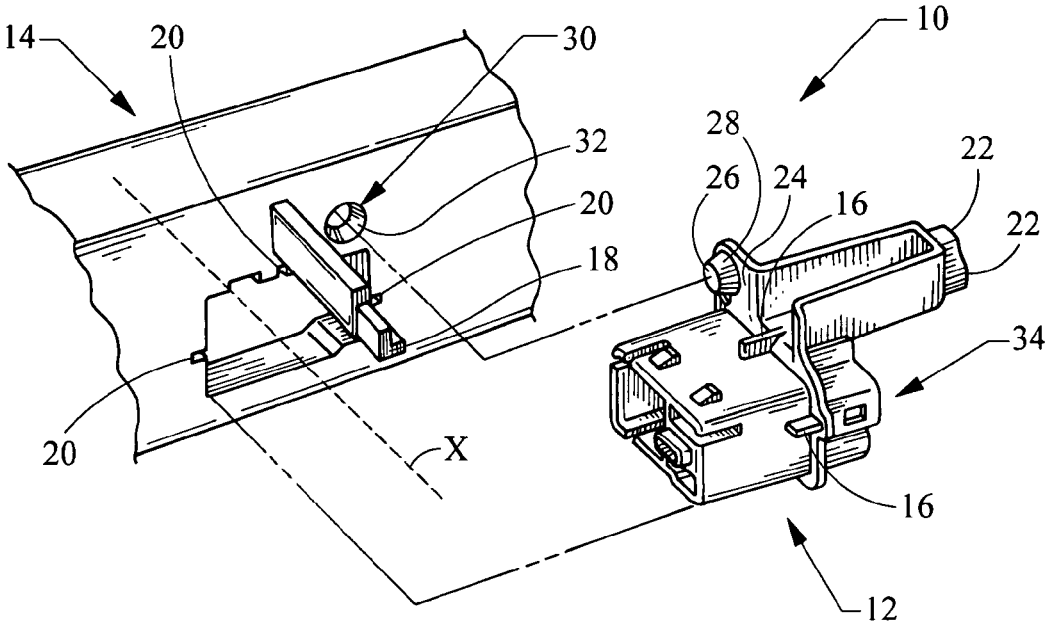
FIG. 1 is an exploded view of a push button assembly embodying the principles of the present invention.

With reference to FIG. 1, a push button assembly is provided and generally indicated at 10. The push button assembly 10 includes a button retainer 12 and a corresponding bezel structure 14. The button retainer 12 has a plurality of drawer slide guides 16. The bezel structure 14 may also have drawer slide guides 18. The drawer slide guides 16, 18 are generally disposed along multiple planes that are perpendicular to each other, while each still runs parallel to a principal axis of translational motion X. As shown in FIG. 1, the button retainer 12 is oriented ninety (90) degrees from the principal axis of translational motion X in order to show the features of the button retainer 12, but it should be understood that the button retainer 12 is configured to mate with the bezel structure 14 and slide along the principal axis of translational motion X.

The bezel structure 14 has a plurality of corresponding surfaces 20 that mate with the drawer slide guides 16. Likewise, the button retainer 12 has corresponding surfaces 22 to mate with the drawer slide guides 18 of the bezel structure 14. It should be understood that, in the alternative, the drawer slide guides 16, 18 and the corresponding surfaces 20, 22 could be provided on only one of the button retainer 12 and bezel structure 14, instead of each being provided on both.

The button retainer 12 has a surface 24 that is disposed perpendicular to the principal axis of translational motion X. In the embodiment of FIG. 1, a conical protrusion 26 extends from the surface 24. The conical protrusion 26 includes an outer conical side 28 having a perimeter extending around the conical protrusion 24. Preferably, the conical protrusion 26 has a cone angle in the range of 20 to 30 degrees; however, it is contemplated that the conical protrusion 26 could have other cone angles without falling beyond the spirit and scope of the present invention.

The bezel structure 14 has portions 30 forming a conical indentation. The portions 30 forming the conical indentation include an inner conical side 32 that has an inner perimeter extending around its inside.

The outer conical side 28 is configured to mate with the inner conical side 32 in a pre-load position. In other words, when the button retainer 12 is slid into the bezel structure 14, a pre-load force is exerted upon the button retainer 12, which holds the button retainer to the bezel structure 14. In one embodiment, this pre-load force may be accomplished by utilizing switchmat domes (not shown) on a rear side 34 of the button retainer 12. The switchmat domes contain electrical contacts to activate a desired function, and they also exert a spring force on the rear side 34 of the button retainer 12 to bias the button retainer 12 toward the bezel structure 14. The spring force may be approximately three Newtons (3 N), although it should be understood that any suitable spring force may be used. It should be understood by one having skill in the art that the pre-load force may alternatively be exerted through other means, such as tact switches.

Figure 2:
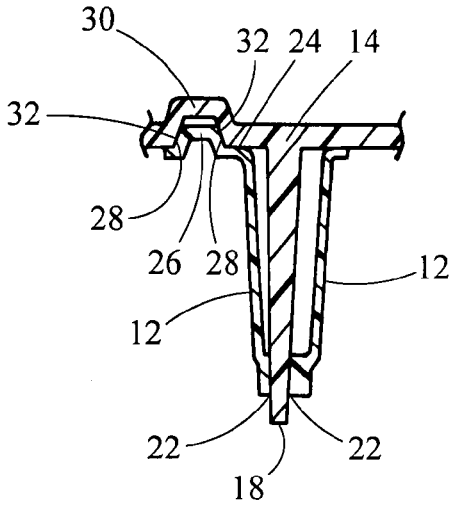
FIG. 2 is cross-sectional view of the push button assembly of FIG. 1.

Thus, in the pre-load position, the outer and inner conical sides 28, 32 contact each other around each of their perimeters. With reference to FIG. 2, a cross-sectional view of the button retainer 12 and the corresponding bezel structure 14 are illustrated. It may be seen in FIG. 2 that the inner conical side 32 is in contact with the outer conical side 28 around the diameter, or the perimeter, of each. This provides a limit to the wobble of the button retainer 12 when the button retainer 12 is in the pre-load position. Because wobble is limited in this way, it is not necessary to also tune the drawer slide guides 16, 18 and corresponding surfaces 20, 22 to extremely tight tolerances.

More specifically, it is typical in the art to provide a 0.07 millimeter gap between the drawer slide guides 16, 18 and the corresponding surfaces 20, 22. This small gap is desired because a larger gap may provide an excessive amount of wobble; however, such a small gap creates friction, especially when surrounding conditions such as pressure and temperature vary. Because the conical aperture 26 and portions 30 forming the conical indentation limit wobble in the pre-load position, it is acceptable to provide a gap in the range of 0.10 to 0.30 millimeter between the drawer slide guides 16, 18 and the corresponding surfaces 20, 22.

When the button retainer 12 is depressed, the conical protrusion 26 moves away from the portions 30 forming the conical indentation. Because the gap between the drawer slide guides 16, 18 and the corresponding surfaces 20, 22 is larger, friction is reduced and the button retainer 12 may be slid along the principal translational axis X in various ambient conditions without encountering an excessive amount of friction.

Although the conical protrusion 26 is shown in FIG. 1 as being located on the surface 24 of the button retainer 12, it is contemplated by the present invention that, instead, the conical protrusion 26 could be located on the bezel structure 14. In such an embodiment, the corresponding portions 30 forming the conical indention would be located on the surface 24 or other suitable surface of the button retainer 12.

Furthermore, although the protrusion 26 is illustrated having a conical shape, the protrusion 26 and corresponding portions 30 could alternatively have an elliptical shape. An elliptical protrusion and corresponding portions forming an indentation would provide the added benefit of limiting wobble and twist along multiple axes.

The present invention also provides a novel method to tune the button retainer 12 to fit the bezel structure 14 of a push button assembly 10 or a hinge button assembly (not shown). Typical methods of producing button retainers 12 and bezel structures 14 involve Electrode Discharge Machining (EDM), multiple levels of tooling changes, and combinations of welding and CNC machining. The tuning process is complicated due to the extremely tight tolerances that have been desired between the drawer slide guides 16, 18 and corresponding surfaces 20, 22.

The novel method according to one aspect of the present invention involves providing an attachment pair of molding tools created from standard bar stock or other suitable material. The attachment pair includes a cone mold pin and a corresponding conical pocket pin, which may each be attached to a button retainer mold and a bezel structure mold to form the portions of the button retainer and bezel structure that include the conical protrusion and portions forming the conical indentation.

The attachment pair is preferably machined to one side of a predetermined tolerance band from traditional methods, such as a lathe, and attached to the desired mold cavity. The mold cavities, including the bezel mold and the retainer mold, have apertures for attaching one of the attachment pair thereto. The cone mold pin may be attached to the bezel mold for use therewith, and the conical pocket pin may be attached to the retainer mold for use therewith, or vice versa.

The button retainer 12 and corresponding bezel structure 14 are molded, preferably by injection molding, and the fit of the conical protrusion 26 within the portions 30 forming the conical indentation are examined to determine whether the perimeters of the inner and outer conical sides 28, 32 are in contact with each other around the diameter of each. If the inner and outer conical sides 28, 32 do not contact each other around their perimeters, at least one of the attachment pair (the cone mold pin, the conical pocket pin, or both) is removed from the bezel or the retainer mold and altered, preferably by traditional machining methods. After at least one of the attachment pair is altered, it is reattached to the corresponding mold, and at least one of the button retainer 12 and corresponding bezel structure 14 is remolded. This process of tuning the fit of the conical protrusion 26 to the portions 30 forming the conical indentation is repeated until the inner and outer conical sides 28, 32 contact each other around their perimeters.

As a person skilled in the art will readily appreciate, the above description is meant as an illustration of implementation of the principles of this invention. This description is not intended to limit the scope or application of this invention in that the invention is susceptible to modification, variation, and change without departing from the spirit of this invention, as defined in the following claims.

The invention claimed is:

1. A push button assembly, comprising:

a button retainer having:

a first drawer slide guide disposed along a first plane, the first plane being parallel to a principal translational axis of the button retainer;

a second drawer slide guide disposed along a second plane, the second plane being parallel to the principal translational axis of the button retainer, the second plane being perpendicular to the first plane;

a surface disposed along a third plane, the third plane being perpendicular to the first and second planes and the principal translational axis; and a bezel structure having:

a plurality of corresponding surfaces, each corresponding surface being mated with one of the first and second drawer slide guides; and one of the button retainer and the bezel structure including a conical protrusion extending therefrom and the other of the button retainer and bezel structure including portions forming a conical indentation, the conical protrusion including an outer conical side having an outer perimeter, the portions forming the conical indentation including an inner conical side having an inner perimeter, the outer conical side being configured to mate with the inner conical side in a pre-load position of the push button assembly, wherein in the pre-load position the outer and inner conical sides substantially contact each other around their perimeters, and in a depressed position of the push button assembly the conical protrusion is located away from the portions forming the conical indentation.

2. The push button assembly of claim 1, wherein the conical protrusion has a cone angle in the range of about 20 to 30 degrees.

3. The push button assembly of claim 1, wherein a gap of at least 0.1 millimeter is provided between the drawer slide guides and the corresponding surfaces.

4. The push button assembly of claim 1, further comprising a switchmat dome that biases the button retainer toward the bezel structure in the pre-load position.

5. The push button assembly of claim 1, further comprising a tact switch that biases the button retainer toward the bezel structure in the pre-load position.

6. The push button assembly of claim 1, wherein the conical protrusion extends from the button retainer.

7. The push button assembly of claim 6, wherein the conical protrusion extends from the surface disposed along the third plane.

8. The push button assembly of claim 1, wherein the conical protrusion extends from the bezel structure.

9. A push button assembly, comprising:

a button retainer having:

a first drawer slide guide disposed along a first plane, the first plane being parallel to a principal translational axis of the button retainer;

a second drawer slide guide disposed along a second plane, the second plane being parallel to the principal translational axis of the button retainer, the second plane being perpendicular to the first plane;

a surface disposed along a third plane, the third plane being perpendicular to the first and second planes and the principal translational axis; and a bezel structure having:

a plurality of corresponding surfaces, each corresponding surface being mated with one of the first and second drawer slide guides; and one of the button retainer and the bezel structure including an elliptical protrusion extending therefrom and the other of the button retainer and bezel structure including portions forming an elliptical indentation, the elliptical protrusion including an outer elliptical side having an outer perimeter, the portions forming the elliptical indentation including an inner elliptical side having an inner perimeter, the outer elliptical side being configured to mate with the inner elliptical side in a pre-load position of the push button assembly, wherein in the pre-load position the outer and inner elliptical sides substantially contact each other around their perimeters, and in a depressed position of the push button assembly the elliptical protrusion is located away from the portions forming the elliptical indentation.

10. The push button assembly of claim 9, wherein a gap of at least 0.1 millimeter is provided between the drawer slide guides and the corresponding surfaces.

11. The push button assembly of claim 9, further comprising a switchmat dome that biases the button retainer toward the bezel structure in the pre-load position.

12. The push button assembly of claim 9, further comprising a tact switch that biases the button retainer toward the bezel structure in the pre-load position.

13. The push button assembly of claim 9, wherein the elliptical protrusion extends from the button retainer.

14. The push button assembly of claim 13, wherein the elliptical protrusion extends from the surface disposed along the third plane.

15. The push button assembly of claim 9, wherein the elliptical protrusion extends from the bezel structure.

16. A method of producing a button assembly, comprising:

providing an attachment pair, the attachment pair comprising a cone mold pin and a corresponding conical pocket pin for use with one of a retainer mold and a bezel mold;

providing a retainer mold for molding a button retainer, the retainer mold having an aperture for attaching one of the attachment pair providing a bezel mold for molding a bezel structure, the bezel mold having an aperture for attaching one of the attachment pair;

attaching one of the attachment pair within the aperture of the retainer mold, and attaching the other of the attachment pair within the aperture of the bezel mold;

molding the button retainer from the retainer mold and molding the bezel structure from the bezel mold, resulting in a first molded piece including a conical protrusion having an outer conical side with an outer perimeter and a second molded piece including corresponding portions forming a conical indentation having an inner conical side with an inner diameter;

fitting the conical protrusion within the corresponding conical indentation and determining whether the outer conical side substantially contacts the inner conical side around the perimeters of the inner and outer conical sides;

if the inner and outer conical sides do not substantially contact each other around their perimeters, removing at least one of the attachment pair from one of the bezel mold and the retainer mold, altering the at least one of the attachment pair, reattaching the at least one of the attachment pair to at least one of the retainer mold and the bezel mold, and remolding at least one of the button retainer and the bezel structure;

continuing to remove, alter, and reattach at least one of the attachment pair to at least one of the retainer mold and the bezel structure, and remold at least one of the button retainer and the bezel structure until the inner and outer conical sides substantially contact each other around their perimeters.

17. The method of claim 16, wherein the step of altering the at least one of the attachment pair is by machining the at least one of the attachment pair.

18. The method of claim 16, wherein the step of providing attachment pair includes creating the attachment pair from bar stock.

19. The method of claim 16, wherein the step of molding the button retainer and the bezel structure is performed by injection molding.

* * * * *